US012742286B2

(12) United States Patent
She et al.

(10) Patent No.: US 12,742,286 B2
(45) Date of Patent: Sep. 22, 2026

(54) INTERFACE COATING PROCESS

(71) Applicant: RTX Corporation, Farmington, CT (US)

(72) Inventors: Ying She, Rocky Hill, CT (US); Jun Nable, Hamden, CT (US); Jonas Banhos, West Hartford, CT (US)

(73) Assignee: RTX Corporation, Farmington, CT (US)

( * ) Notice: Subject to any disclaimer, the term of this patent is extended or adjusted under 35 U.S.C. 154(b) by 334 days.

(21) Appl. No.: 18/437,742

(22) Filed: Feb. 9, 2024

(65) Prior Publication Data

US 2025/0257525 A1 Aug. 14, 2025

(51) Int. Cl.

| | |
|---|---|
| ***D06M 23/00*** | (2006.01) |
| ***D06M 10/02*** | (2006.01) |
| ***D06M 11/58*** | (2006.01) |
| ***D06M 23/10*** | (2006.01) |

(52) U.S. Cl.

CPC ..... *D06M 23/10* (2013.01); *D06M 10/02* (2013.01); *D06M 11/58* (2013.01)

(58) Field of Classification Search

CPC ..... D06M 23/10; D06M 10/02; D06M 11/58; C04B 35/62892; C04B 2235/5244; C04B 2235/5256; C04B 2235/5454; C04B 2235/614; C04B 2235/616; C04B 35/565; C04B 35/62884; C04B 35/62886; C04B 35/62894; C04B 35/62897; C04B 35/80; C04B 35/62868

USPC ..... 8/115.6

See application file for complete search history.

(56) References Cited

U.S. PATENT DOCUMENTS

| | | | |
|---|---|---|---|
| 10,745,325 | B2 | 8/2020 | Shim et al. |
| 11,072,565 | B2 | 7/2021 | Weaver et al. |
| 11,220,465 | B2 | 1/2022 | Kubo et al. |
| 11,697,623 | B2 | 7/2023 | Crutchfield |
| 2017/0029339 | A1 | 2/2017 | Weaver et al. |
| 2017/0029340 | A1 | 2/2017 | Weaver et al. |
| 2022/0055957 | A1 | 2/2022 | Shim et al. |
| 2024/0051879 | A1* | 2/2024 | Colby ..... C04B 35/62873 |

FOREIGN PATENT DOCUMENTS

| | | |
|---|---|---|
| EP | 1640352 B1 | 5/2007 |
| EP | 3502307 A1 | 6/2019 |
| EP | 4321495 A1 | 2/2024 |

OTHER PUBLICATIONS

Extended European Search Report for EP Application No. 25155877.1, dated Jun. 30, 2025, 7 pages.

* cited by examiner

*Primary Examiner* — Eisa B Elhilo
(74) *Attorney, Agent, or Firm* — Kinney & Lange, P.A.

(57) ABSTRACT

A method for applying an interface coating to fibers in the manufacture of a fiber-reinforced composite material includes separating a plurality of fibers with a plurality of spacers disposed between adjacent fibers and depositing, via chemical vapor infiltration, an interface coating on the plurality of fibers. The plurality of spacers comprises hexagonal-boron nitride nanoparticles.

17 Claims, 2 Drawing Sheets

INTERFACE COATING PROCESS

BACKGROUND

The present disclosure relates generally to the manufacture of fiber-reinforced ceramic matrix materials (CMCs) and, more particularly, to processes for depositing interface coatings on fibers.

Fiber-reinforced CMCs have been developed for the manufacture of components that are exposed to high temperatures, corrosive environments, and mechanical stress. CMCs are of particular interest in the aerospace industry and their use has been widely adopted for high temperature aircraft applications. While CMCs can provide superior properties, they are susceptible to degradation. Over time, ceramic materials can form microcracks that expose the ceramic material to oxygen or other corrosive species. To limit damage to fibers or through-thickness cracks, fibers can be coated with one or more rigidized interfacial coating (IFC) layers. Interface coatings deposited on fibers of silicon-based CMCs have two primary functions: (1) form a weak bond between the fiber and matrix to promote crack deflection and (2) protect the fiber from external oxidative degradation. One widely used IFC material is hexagonal-boron nitride (h-BN), which has a low shear strength and strong oxidation resistance capability. Typically, IFCs, including h-BN, silicon-doped BN, and other IFC materials are deposited on surfaces of fibers in a woven fiber preform of a component. In this case, the IFC coatings are deposited in a chemical vapor deposition (CVD) reactor containing multiple fiber preforms.

While the interfacial material can infiltrate the fiber preform, the IFC process is limited by inadequate fiber tow spreading, resulting in fiber-to-fiber contact areas inaccessible to IFC materials. As a result, IFCs can be absent in areas where adjacent fibers are in contact. Insufficient IFC coverage can occur within fiber tows and between adjacent fiber tows.

SUMMARY

In one aspect, a method for applying an interface coating to fibers in the manufacture of a fiber-reinforced composite material includes separating a plurality of fibers with a plurality of spacers disposed between adjacent fibers and depositing, via chemical vapor infiltration, an interface coating on the plurality of fibers. The plurality of spacers comprises hexagonal-boron nitride nanoparticles.

In another aspect, a method for applying an interface coating to fibers in the manufacture of a fiber-reinforced composite material includes applying a colloidal solution of hexagonal-boron nitride nanoparticles to a plurality of fibers, separating the plurality of fibers and distributing the hexagonal-boron nitride nanoparticles between adjacent fibers, wherein the hexagonal-boron nitride particles form spacers between adjacent fibers, and depositing, via chemical vapor infiltration, an interface coating on the plurality of fibers.

The present summary is provided only by way of example, and not limitation. Other aspects of the present disclosure will be appreciated in view of the entirety of the present disclosure, including the entire text, claims and accompanying figures.

Figure 1:
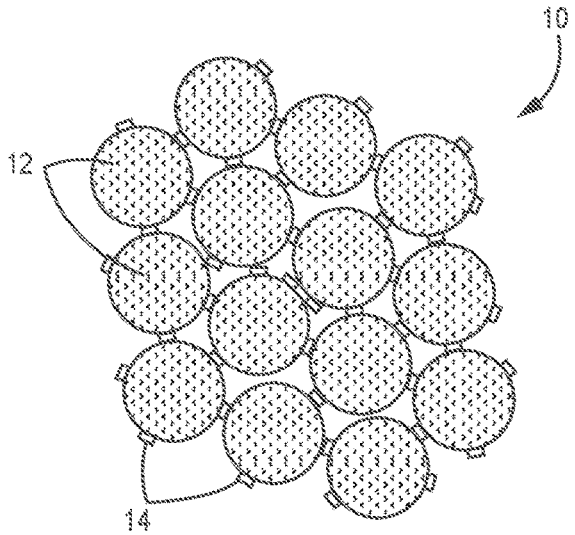
FIG. 1 is a schematic cross-sectional view of a plurality of fibers in a fiber tow separated by hexagonal-boron nitride (h-BN) nanoparticles.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present disclosure is directed to a process for applying an interfacial coating (IFC) to fibers in the manufacture of a fiber-reinforced ceramic matrix composite (CMC). Current chemical vapor deposition (CVD)/chemical vapor infiltration (CVI) methods for depositing IFC materials on fibers are limited by insufficient fiber tow spreading, which results in fiber-to-fiber contact areas inaccessible to IFC materials. The disclosed process reduces the fiber-to-fiber contact areas and enhances tow spreading by providing hexagonal-boron nitride (h-BN) nanoparticle spacers between fibers of a fiber preform prior to depositing an IFC via conventional CVD/CVI processing. The space formed in between fibers by the h-BN nanoparticles allows the subsequent CVD/CVI IFC process to access previously inaccessible areas between fibers leading to more uniform coating on the fiber surfaces.

FIG. 1 is a schematic cross-sectional view of portion of fiber tow 10. Fiber tow 10 includes a plurality of fibers 12 or filaments separated by hexagonal-boron nitride (h-BN) nanoparticles 14. The h-BN nanoparticles 14 function as spacers to separate adjacent fibers 12 and reduce fiber-to-fiber contact area for deposition of an IFC via CVD/CVI. FIG. 1 shows h-BN nanoparticles 14 dispersed within fiber tow 10 prior to deposition of an IFC via CVI/CVD.

Fibers 12 can be formed from silicon carbide (SiC) or other suitable ceramic material. Fibers 12 can be generally cylindrical and formed into bundled fiber tows. Fibers 12 can have a diameter generally ranging from 7 to 12 microns. Each fiber tow 10 can generally include 500 or more fibers 12. Fiber tows 10 can be arranged in woven or braided architectures, including, for example, 2D woven or braided fiber plies, e.g., fabric sheets, (shown in FIG. 2) or 3D woven fiber preforms, as known in the art.

Figure 3:
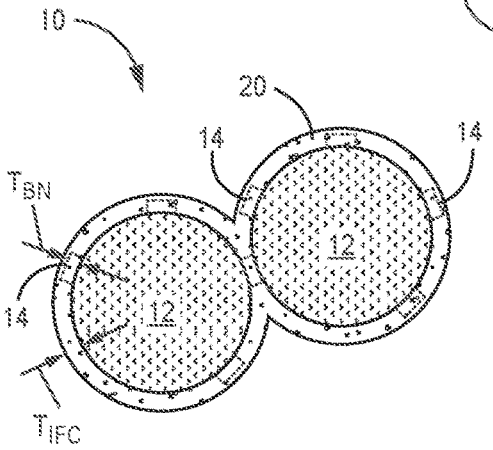
FIG. 3 is a schematic cross-sectional view of a fibers separated by h-BN nanoparticles and coated with an interfacial coating (IFC).

H-BN has a layered crystal structure comprising a plurality of nanosheets. H-BN nanoparticles 14 can comprise one or more nanosheets arranged in a stacked configuration. A lateral dimension of h-BN nanoparticles 14 can differ from a stack thickness of h-BN nanoparticles 14. H-BN nanoparticles 14 can have a thickness, as measured from a surface of fibers 12 radially outward when h-BN nanoparticles 14 are disposed on the surface of fibers 12, less than a thickness of an IFC. Preferably, h-BN nanoparticles 14 can have a thickness less than 50 nanometers to accommodate an IFC having a thickness of 50 nanometers or greater. In some embodiments, h-BN nanoparticles 14 can have a thickness equal to or less than 25 nanometers to accommodate thinner IFC layers. Preferably, h-BN nanoparticles 14 do not protrude outward of the IFC following IFC deposition via CVD/CVI (e.g., FIG. 3 shows IFC 20 encasing h-BN nanoparticles 14).

H-BN nanoparticles 14 are disposed on the surfaces of fibers 12. As illustrated in FIG. 1, a portion of h-BN nanoparticles 14 can be disposed between and in contact with adjacent fibers 12, functioning as spacers to separate adjacent fibers 12 and to reduce fiber-to-fiber contact along a length of fibers 12. Some h-BN nanoparticles 14 can be disposed in contact with a single fiber 12 where a gap between adjacent fibers 12 already exists. H-BN nanoparticles 14 can be non-uniformly distributed about each of a circumference and a length of fibers 12. FIG. 1 is intended to illustrate spacing provided by h-BN nanoparticles between adjacent fibers and is not intended to indicate a preferred arrangement, size, shape, or configuration or h-BN nanoparticles relative to fibers 12. It will be understood by one of ordinary skill in the art that the distribution of h-BN nanoparticles through fiber tow 10 and along surfaces of fibers 12 is dependent on the concentration of h-BN nanoparticles in a colloidal solution applied to fiber tow 10 and migration caused by ultrasonic vibration applied to fibers 12 and the colloidal solution, as described further herein. The amount of h-BN nanoparticles can be selected to provide a desired reduction in fiber-to-fiber contact area while also maintaining sufficient connected gaps or open channels around fibers 12 or through fiber tow 10 to maintain accessibility of surfaces of fibers 12 to IFCs applied via CVD/CVI.

Figure 2:
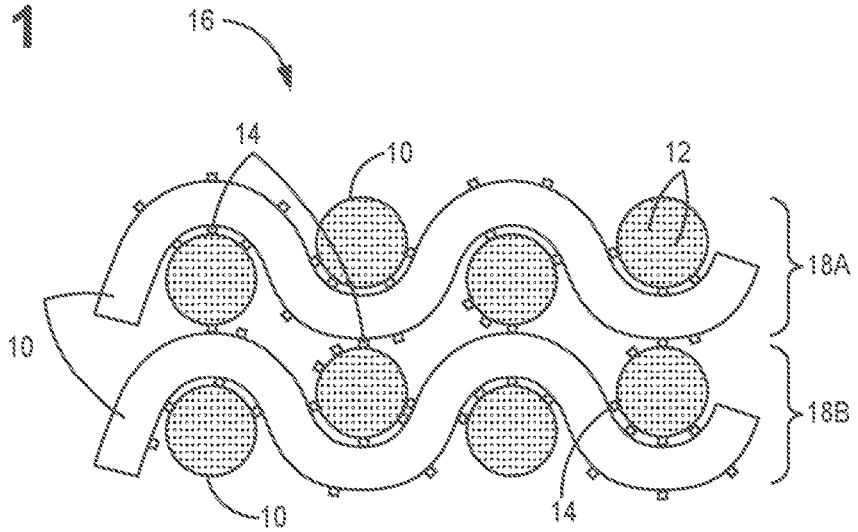
FIG. 2 is a schematic cross-sectional view of a plurality of woven fiber tows separated by h-BN nanoparticles.

FIG. 2 is a schematic cross-sectional view of a portion of fiber preform 16 having a plurality of fiber tows 10 arranged in woven or braided fiber plies 18A and 18B with fiber tows 10 within a single woven fiber plies 18A, 18B and in adjacent woven fiber plies 18A and 18B separated by h-BN nanoparticles 14. FIG. 2 shows two fiber plies 18A and 18B stacked to form a portion of fiber preform 16. H-BN nanoparticles 14 are dispersed through fiber tows 10 to separate fibers 12, as described with respect to FIG. 1. In addition, h-BN nanoparticles dispersed on outermost fibers 12 of fiber tows 10 can separate fibers 12 in adjacent fiber tows 10 within a single fiber ply (e.g., 18A) and in adjacent fiber plies (e.g., 18A and 18B).

FIG. 2 illustrates a portion of fiber preform 16 formed of a plurality of fiber plies 18A and 18B. Fiber preform 16 can include any desired number of fiber plies 18A, 18B and/or additional woven or braided fiber wraps. In some embodiments, fiber preform 16 can additionally include 3D woven fiber structures or can be formed of a 3D woven fiber structure as known in the art.

Fiber tows 10 include fibers 12 as described with respect to FIG. 1. As illustrated in FIG. 2, fiber tows 10 can be woven to form fiber plies 18A and 18B. Fiber plies 18A and 18B can have any type of weave or braided architecture known in the art and suitable for CMC manufacture.

H-BN nanoparticles 14 can be dispersed on surfaces of fibers 12 within fiber tows 10, as described with respect to FIG. 1, and on surfaces of the outermost fibers 12 of fiber tows 10. As shown in FIG. 2, a portion of h-BN nanoparticles 14 can be disposed between and in contact with fibers 12 of adjacent fiber tows 10, functioning as spacers to separate fibers 12 of adjacent fiber tows 10 and to reduce fiber-to-fiber contact along a length of adjacent fiber tows 10 within a single fiber ply (e.g., 18A) and in adjacent fiber plies (e.g., 18A and 18B). As previously described, h-BN nanoparticles 14 can be non-uniformly distributed about each of a circumference and a length of fibers 12. FIG. 2 is intended to illustrate spacing provided by h-BN nanoparticles between fibers 12 of adjacent fiber tows 10 and is not intended to indicate a preferred arrangement, size, shape, or configuration or h-BN nanoparticles relative to fiber tows 10. It will be appreciated that neither FIG. 1 nor 2 are drawn to scale and that the scale of FIGS. 1 and 2 do not match as necessary for illustrative purposes.

As previously described, it will be understood by one of ordinary skill in the art that the distribution of h-BN nanoparticles through fiber tow 10 and along surfaces of outermost fibers 12 of fiber tows 10 is dependent on the concentration of h-BN nanoparticles in a colloidal solution applied to fiber tow 10 and migration caused by ultrasonic vibration applied to fibers 12 and the colloidal solution, as described further herein. The amount of h-BN nanoparticles can be selected to provide a desired reduction in fiber-to-fiber contact area while also maintaining sufficient connected gaps or open channels around fiber tows 10 to maintain accessibility of surfaces of the outermost fibers 12 of fiber tows 10 to IFCs applied via CVD/CVI.

FIG. 3 is a schematic cross-sectional view of fibers 12 of fiber tow 10 following deposition of IFC 20. As shown in FIG. 3, IFC 20 can encase fibers 12 and h-BN nanoparticles 14. H-BN nanoparticles 14 maintain a gap between fibers 12 to allow for the infiltration of IFC 20 during CVD/CVI. H-BN nanoparticles preferably have a thickness TBN less than a thickness of IFC 20 $T_{IFC}$ such that h-BN nanoparticles disposed in contact with a single fiber surface (i.e., not at a location of intersecting fibers 12) is covered by IFC 20 and does not protrude through or outward from IFC 20. IFC 20 can have a thickness $T_{IFC}$ ranging, for example, from 25 nanometers to 300 nanometers. IFC 20 formed of h-BN and h-BN nanoparticles 14 may be indistinguishable following depositing of IFC 20 on fibers 12. In some embodiments, IFC 20 may include additional layers of differing materials deposited as an IFC system as known in the art.

Figure 4:
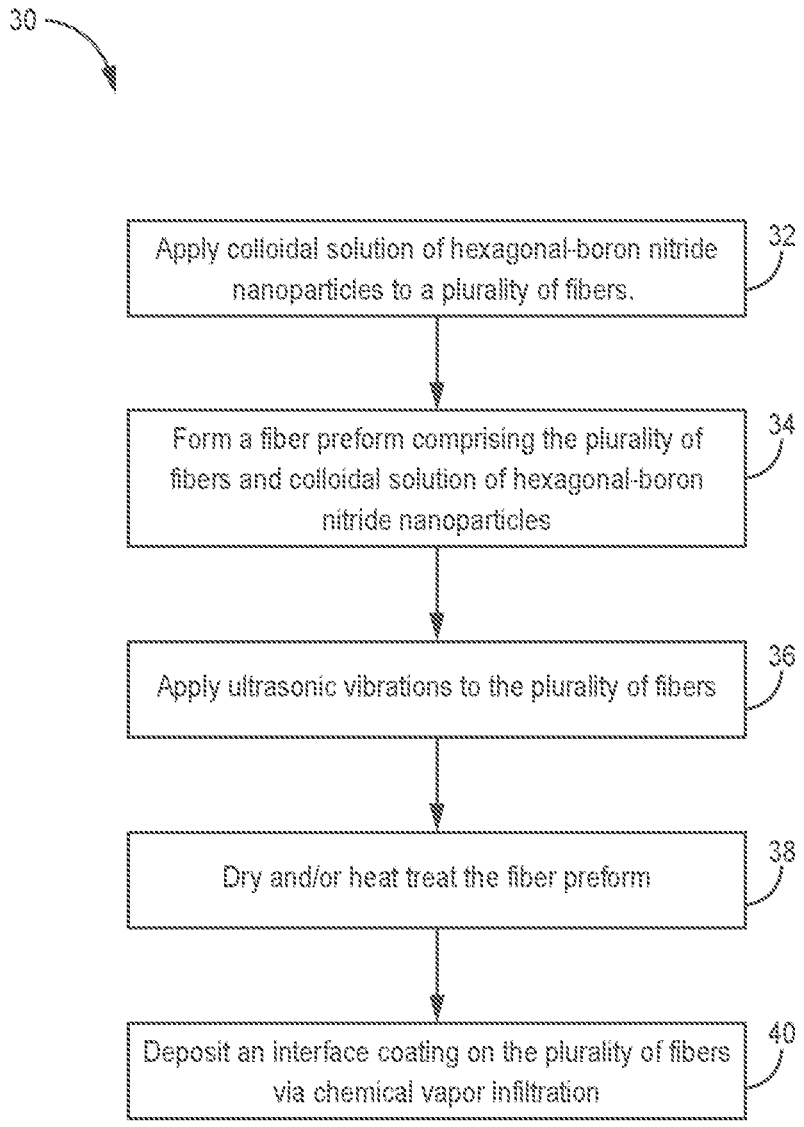
FIG. 4 is a flowchart of a method for providing an interfacial coating to fibers in the manufacture of a fiber-reinforced ceramic matrix composite (CMC).

FIG. 4 is a flow chart of method 30 for providing an IFC to fibers in the manufacture of a fiber-reinforced CMC. Method 30 is used to provide h-BN nanoparticles 14 between adjacent fibers 12 to separate adjacent fibers 12 and reduce the fiber-to-fiber contact area as shown in and described with respect to FIGS. 1-3.

In step 32, a colloidal solution of h-BN nanoparticles is applied to a plurality of fibers. The colloidal solution can be an aqueous-based or solvent-based solution and includes h-BN nanoparticles of a desired size to function as spacers between adjacent fibers within a fiber tow and in adjacent fiber tows. The colloidal solution can be prepared, for example, using an exfoliation and dispersion process as known in the art. The colloidal solution may contain additives suitable to maintain h-BN nanoparticles evenly distributed in solution. The concentration of h-BN nanoparticles in the colloidal solution can be selected to provide a desired amount of h-BN nanoparticles to the fibers of the fiber tow, fiber ply, or fiber preform.

The exfoliation process can be designed to provide a desired size of h-BN nanoparticles. As previously described, the size of the h-BN nanoparticles is preferably less than a thickness of the IFC to allow the IFC to coat the h-BN nanoparticles. Additionally, the size of the h-BN nanoparticles is selected to be large enough to provide spacing between adjacent fibers sufficient for infiltration of the IFC during a CVD/CVI process, while small enough to move between adjacent fibers within a fiber tow. In some embodiments, the h-BN nanoparticles can comprise multiple nanosheets to a height (thickness) of less than 50 nanometers, or less than 25 nanometers. The lateral dimension of the nanosheets may also be less than 50 nanometers, or less than 25 nanometers. In some embodiments, the lateral dimension may be greater than the thickness.

The colloidal solution can be applied to a fiber ply (e.g., a 2D woven or braided fiber sheet as described with respect to FIG. 2). In alternative embodiments, the colloidal solution may be applied to individual fiber tows or a 3D fiber preform. The colloidal solution can be applied, for example, by dipping the fibers in the colloidal solution or brushing the colloidal solution on the fibers. For example, a fiber ply can be dipped in the colloidal solution and wetted by the colloidal solution such that h-BN nanoparticles of the colloidal solution are retained in the fiber ply. The amount of colloidal solution applied to the fiber ply, fiber tow, or fiber preform should be sufficient to effectively fill spaces between fibers of at least partially surrounds individual fibers within the fiber tows. The concentration of h-BN nanoparticles in the colloidal solution should be sufficient to ensure that the desired amount of h-BN nanoparticles is retained by the fibers in the fiber tows. Colloidal solutions of 0.5 to 30 mg/ml h-BN nanoparticles having a size of approximately 2.5 nm thick and 10-50 nm in lateral dimension have been shown to be stable.

In step 34, a fiber preform is formed comprising the colloidal solution of h-BN nanoparticles. The fiber preform can be formed by stacking multiple fiber plies wetted with the colloidal solution. Preferably, the colloidal solution can be applied to individual fiber plies prior to ply layup to help ensure that the innermost portions of the fiber preform are wetted with the colloidal solution and that the h-BN nanoparticles are substantially evenly distributed throughout the fiber preform. A sufficient amount of the colloidal solution can be applied to ensure that the fiber plies are saturated or that the colloidal solution has infiltrated the individual fiber tows such that the colloidal solution at least partially surrounds individual fibers within the fiber tows.

In other embodiments, a 3D fiber preform (e.g., 3D woven structure) can be formed prior to application of the colloidal solution. For example, a 3D woven fiber preform may be dipped or soaked in the colloidal solution of h-BN nanoparticles to ensure that the colloidal solution infiltrates the innermost portion of the fiber preform.

In step 36, ultrasonic vibrations are applied to the fibers of the fiber preform to separate adjacent fibers and redistribute h-BN nanoparticles between adjacent fibers to maintain a separation between adjacent fibers and reduce the fiber-to-fiber contact area. The fiber preform wetted with the colloidal solution can be disposed in a tooling as known in the art to hold a desired shape of the fiber preform. The tooling can be placed in an ultrasonic bath to apply ultrasonic vibration to fibers of the fiber preform. The ultrasonic vibration can cause adjacent fibers to separate and allow h-BN nanoparticles to migrate therebetween. The position of the h-BN nanoparticles between adjacent fibers can be retained when ultrasonic vibration is ceased such that the spacing between adjacent fibers is retained by the h-BN nanoparticle spacers and the fiber-to-fiber contact area is reduced as illustrated in FIGS. 1-3 and discussed with respect thereto.

In step 38, the fiber preform can be dried and/or heat treated to remove the liquid of the colloidal solution and any undesirable additives. Drying and/or heat treatment can be conducted using methods known in the art and suitable for removing liquid and any additive present in the colloidal solution and without adverse effect on the distribution of h-BN nanoparticles disposed to separate adjacent fibers. The h-BN nanoparticles are retained in the drying and/or heat treatment processes and maintain separation of adjacent fibers.

In step 40, the IFC is deposited on the fibers of the fiber preform using a CVD/CVI process known in the art. The fiber preform having the h-BN nanoparticles as shown in FIGS. 1 and 2 can be placed in a CVD reactor for deposition of an h-BN IFC. The h-BN nanoparticles can maintain spacing between adjacent fibers sufficient to allow IFC to infiltrate fiber tows and substantially coat the fibers. The h-BN nanoparticles reduce the fiber-to-fiber contact area thereby increasing the portion of the fiber coated with the IFC. The h-BN nanoparticles can be encased by the IFC and become part of the IFC.

Method 30 may include additional steps and/or materials not discussed herein as may be necessary and as known in the art for forming and sizing a fiber preform and/or depositing an IFC.

Following deposition of the IFC, the fiber preform can be densified with a matrix material, such as SiC, as known in the art. Matrix material can be deposited directly on the IFC. Densification can be achieved using CVI, polymer infiltration and pyrolysis, slurry infiltration, melt infiltration, and combinations thereof as known in the art. Densification can be carried out until the resulting CMC has reached the desired residual porosity. Additional finishing processes as known in the art may be conducted to produce a final component.

The disclosed method can be used in the manufacture of CMC components suitable for use in, for example, a gas turbine engine and, particularly, for use in high temperature and/or corrosive environments (e.g., turbine blades, vanes, seals, and platforms, and combustor panels), however is not limited to any particular application or operational environment.

The disclosed method for applying an IFC to fibers in the manufacture of a fiber-reinforced CMC reduces the fiber-to-fiber contact areas and enhances tow spreading by providing h-BN nanoparticle spacers between fibers of a fiber preform prior to depositing an IFC via conventional CVD/CVI processing. The space formed in between fibers by the h-BN nanoparticles allows the subsequent CVD/CVI IFC process to access previously inaccessible areas between fibers leading to more uniform coating on the fiber surfaces.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The embodiments disclosed herein are intended to provide an explanation of the present invention and not a limitation of the invention. The present invention is not limited to the embodiments disclosed. It will be understood by one skilled in the art that various modifications and variations can be made to the invention without departing from the scope and spirit of the invention.

Discussion of Possible Embodiments

The following are non-exclusive descriptions of possible embodiments of the present invention.

A method for applying an interface coating to fibers in the manufacture of a fiber-reinforced composite material includes separating a plurality of fibers with a plurality of spacers disposed between adjacent fibers and depositing, via chemical vapor infiltration, an interface coating on the plurality of fibers. The plurality of spacers comprises hexagonal-boron nitride nanoparticles.

The method of the preceding paragraph can optionally include, additionally and/or alternatively, any one or more of the following features, configurations, additional components, and/or steps:

In an embodiment of the foregoing method, the hexagonal-boron nitride nanoparticles can be applied to the plurality of fibers in a colloidal solution.

In an embodiment of the method of any of the foregoing paragraphs, separating the plurality of fibers with the plurality of spacers can include applying ultrasonic vibration to the plurality of fibers to separate adjacent fibers and to distribute the hexagonal-boron nitride nanoparticles between adjacent fibers.

In an embodiment of the method of any of the foregoing paragraphs, fibers of the plurality of fibers can be arranged in a plurality of fiber tows and, wherein the plurality of fibers tows are arranged in a woven fiber ply.

In an embodiment of the method of any of the foregoing paragraphs, the colloidal solution of hexagonal-boron nitride nanoparticles can be applied to the woven fiber ply.

In an embodiment of the method of any of the foregoing paragraphs, fibers of the plurality of fibers can be arranged in a fiber preform of a component.

In an embodiment of the method of any of the foregoing paragraphs, the fiber preform can be disposed in a tooling and wherein the tooling is disposed in an ultrasonic bath for applying ultrasonic vibration to the fiber preform.

An embodiment of the method of any of the foregoing paragraphs can further include drying and/or heat treating the fiber preform following application of ultrasonic vibration.

In an embodiment of the method of any of the foregoing paragraphs, the interface coating can have a thickness greater than a thickness of the hexagonal-boron nitride nanoparticles, the thickness of the interface coating and the thickness of the hexagonal-boron nitride measured from a surface of the fiber radially outward.

In an embodiment of the method of any of the foregoing paragraphs, the hexagonal-boron nitride nanoparticles can have a thickness less than 50 nanometers.

In an embodiment of the method of any of the foregoing paragraphs, separating the plurality of fibers can provide connected gaps between the plurality of fibers and the plurality of spacers.

In an embodiment of the method of any of the foregoing paragraphs, the interface coating can include hexagonal-boron nitride.

In another aspect, a method for applying an interface coating to fibers in the manufacture of a fiber-reinforced composite material includes applying a colloidal solution of hexagonal-boron nitride nanoparticles to a plurality of fibers, separating the plurality of fibers and distributing the hexagonal-boron nitride nanoparticles between adjacent fibers, wherein the hexagonal-boron nitride particles form spacers between adjacent fibers, and depositing, via chemical vapor infiltration, an interface coating on the plurality of fibers.

The method of the preceding paragraph can optionally include, additionally and/or alternatively, any one or more of the following features, configurations, additional components, and/or steps:

In an embodiment of the foregoing method, separating the plurality of fibers and distributing the hexagonal-boron nitride nanoparticles can include applying ultrasonic vibration to the plurality of fibers.

An embodiment of the method of any of the foregoing paragraphs can further include forming a fiber preform of a component, the fiber preform comprising the plurality of fibers and the colloidal solution of hexagonal-boron nitride and wherein the ultrasonic vibrations are applied to the fiber preform.

In an embodiment of the foregoing method, the fiber preform can include a plurality of woven fiber plies arranged in a stack, wherein the colloidal solution of hexagonal-boron nitride nanoparticles is applied to each fiber ply before arranging the plurality of fiber plies in a stack.

In an embodiment of the foregoing method, a first subset of the hexagonal-boron nitride nanoparticles can be disposed between adjacent fibers of the fiber tows and separate the adjacent fibers within the fiber tows, and wherein a second subset of the plurality of the hexagonal-boron nitride nanoparticles is disposed between fibers of adjacent fiber tows and separate the fibers of the adjacent fiber tows within a single fiber ply and in adjacent fiber plies.

In an embodiment of the foregoing method, the fiber preform can be disposed in a tooling having a desired shape and wherein the tooling is disposed in an ultrasonic bath for applying ultrasonic vibration to the fiber preform.

An embodiment of the method of any of the foregoing paragraphs can further include drying and/or heat treating the fiber preform following application of ultrasonic vibrations.

In an embodiment of the foregoing method, the interface coating can include hexagonal-boron nitride and has a thickness greater than a thickness of the hexagonal-boron nitride nanoparticles, the thickness of the interface coating and the thickness of the hexagonal-boron nitride measure outward from a surface of the fiber.

The invention claimed is:

1. A method for applying an interface coating to fibers in the manufacture of a fiber-reinforced composite material, the method comprising:

separating a plurality of fibers with a plurality of spacers disposed between adjacent fibers, wherein:

the plurality of spacers comprises hexagonal-boron nitride nanoparticles, the hexagonal-boron nitride nanoparticles applied to the plurality of fibers in a colloidal solution and, separating the plurality of fibers with the plurality of spacers comprises applying ultrasonic vibration to the plurality of fibers to separate adjacent fibers and to distribute the hexagonal-boron nitride nanoparticles between adjacent fibers; and depositing, via chemical vapor infiltration, an interface coating on the plurality of fibers.

2. The method of claim 1, wherein fibers of the plurality of fibers are arranged in a plurality of fiber tows and, wherein the plurality of fibers tows are arranged in a woven fiber ply.

3. The method of claim 2, wherein the colloidal solution of hexagonal-boron nitride nanoparticles is applied to the woven fiber ply.

4. The method of claim 1, wherein fibers of the plurality of fibers are arranged in a fiber preform of a component.

5. The method of claim 4, wherein the fiber preform is disposed in a tooling and wherein the tooling is disposed in an ultrasonic bath for applying ultrasonic vibration to the fiber preform.

6. The method of claim 4, and further comprising drying and/or heat treating the fiber preform following application of ultrasonic vibration.

7. The method of claim 1, wherein the interface coating has a thickness greater than a thickness of the hexagonal-boron nitride nanoparticles, the thickness of the interface coating and the thickness of the hexagonal-boron nitride measured from a surface of the fiber radially outward.

8. The method of claim 7, wherein the hexagonal-boron nitride nanoparticles have a thickness less than 50 nanometers.

9. The method of claim 1, wherein separating the plurality of fibers provides connected gaps between the plurality of fibers and the plurality of spacers.

10. The method of claim 1, wherein the interface coating comprises hexagonal-boron nitride.

11. A method for applying an interface coating to fibers in the manufacture of a fiber-reinforced composite material, the method comprising:

applying a colloidal solution of hexagonal-boron nitride nanoparticles to a plurality of fibers;

applying ultrasonic vibration to the plurality of fibers to separate the plurality of fibers and distribute the hexagonal-boron nitride nanoparticles between adjacent fibers, wherein the hexagonal-boron nitride particles form spacers between adjacent fibers; and depositing, via chemical vapor infiltration, an interface coating on the plurality of fibers.

12. The method of claim 11 and further comprising forming a fiber preform of a component, the fiber preform comprising the plurality of fibers and the colloidal solution of hexagonal-boron nitride and wherein the ultrasonic vibrations are applied to the fiber preform.

13. The method of claim 12, wherein the fiber preform comprises a plurality of woven fiber plies arranged in a stack, wherein the colloidal solution of hexagonal-boron nitride nanoparticles is applied to each fiber ply before arranging the plurality of fiber plies in a stack.

14. The method of claim 13, wherein a first subset of the hexagonal-boron nitride nanoparticles is disposed between adjacent fibers of the fiber tows and separate the adjacent fibers within the fiber tows, and wherein a second subset of the plurality of the hexagonal-boron nitride nanoparticles is disposed between fibers of adjacent fiber tows and separate the fibers of the adjacent fiber tows within a single fiber ply and in adjacent fiber plies.

15. The method of claim 12, wherein the fiber preform is disposed in a tooling having a desired shape and wherein the tooling is disposed in an ultrasonic bath for applying ultrasonic vibration to the fiber preform.

16. The method of claim 12, and further comprising drying and/or heat treating the fiber preform following application of ultrasonic vibrations.

17. The method of claim 12, wherein the interface coating comprises hexagonal-boron nitride and has a thickness greater than a thickness of the hexagonal-boron nitride nanoparticles, the thickness of the interface coating and the thickness of the hexagonal-boron nitride measure outward from a surface of the fiber.

* * * * *